US007568456B2

(12) United States Patent
Kusaka et al.

(10) Patent No.: US 7,568,456 B2
(45) Date of Patent: Aug. 4, 2009

(54) VALVE GEAR

(75) Inventors: Yasushi Kusaka, Susono (JP); Toshiaki Asada, Mishima (JP); Shuichi Ezaki, Susono (JP); Kimitoshi Tsuji, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 364 days.

(21) Appl. No.: 10/577,950

(22) PCT Filed: Dec. 8, 2004

(86) PCT No.: PCT/JP2004/018684

§ 371 (c)(1),
(2), (4) Date: May 2, 2006

(87) PCT Pub. No.: WO2005/057060

PCT Pub. Date: Jun. 23, 2005

(65) Prior Publication Data

US 2007/0068473 A1 Mar. 29, 2007

(30) Foreign Application Priority Data

Dec. 12, 2003 (JP) ..... 2003-415686

(51) Int. Cl.
*F01L 1/34* (2006.01)

(52) U.S. Cl. ..... 123/90.16; 123/90.15

(58) Field of Classification Search ..... 123/90.16
See application file for complete search history.

(56) References Cited

U.S. PATENT DOCUMENTS

| | | | | |
|---|---|---|---|---|
| 5,494,007 | A | 2/1996 | Schroeder et al. | |
| 5,873,335 | A | 2/1999 | Wright et al. | |
| 6,755,166 | B2 * | 6/2004 | Chang et al. | 123/90.26 |
| 7,047,922 | B2 * | 5/2006 | Asada et al. | 123/90.16 |
| 7,055,480 | B2 * | 6/2006 | Kusaka et al. | 123/90.6 |
| 2003/0213452 | A1 | 11/2003 | Pomerleau | |

FOREIGN PATENT DOCUMENTS

| | | |
|---|---|---|
| DE | 101 51 201 A1 | 4/2003 |
| JP | A-59-068509 | 4/1984 |
| JP | U 60-131609 | 9/1985 |
| JP | A-08-177536 | 7/1996 |
| WO | WO 03/025353 A1 | 3/2003 |

* cited by examiner

*Primary Examiner*—Zelalem Eshete
(74) *Attorney, Agent, or Firm*—Oliff & Berridge, PLC

(57) ABSTRACT

There is provided a valve gear of an internal combustion engine converting a rotational motion of a motor into a linear motion by a cam, and driving an intake valve or an exhaust valve of a cylinder so as to be opened and closed based on the linear motion, a motor control apparatus which can actuate the motor in a rocking chive mode in which a rotating direction of the cam is changed during a lift of the valve. The motor control apparatus controls a motion of the motor such that the cam starts rotating before the valve starts lifting in the rocking drive mode.

8 Claims, 14 Drawing Sheets

VALVE GEAR

TECHNICAL FIELD

The present invention relates to a valve gear driving an intake valve or an exhaust valve of an internal combustion engine.

BACKGROUND ART

An intake valve or an exhaust valve of an internal combustion engine is driven so as to be opened and closed by a power taken out from a crank shaft of the internal combustion engine. In recent years, it is tried to drive so as to open and close the intake valve or the exhaust valve by an electric motor. For example, there has been proposed a valve gear which opens and closes the intake valve by rotating a cam shaft by stepping motor (Japanese Patent Application Laid-Open (JP-A) No. 8-177536). In addition, there is JP-A No. 59-68509 as a prior technical document relevant to the present invention.

In a valve drive using an electric motor, since it is possible to drive a cam separately from a rotating speed or a rotating direction of the crank shaft of the internal combustion engine, a freedom of control is high, and it is possible to achieve a valve gear characteristic which cannot been obtained by the conventional mechanical valve gear. However, a specific control method suitable for improving a performance such as an improvement of response has not been clarified.

DISCLOSURE OF THE INVENTION

Accordingly, an object of the present invention is to provide a valve gear of an internal combustion engine which can intend to improve a performance by suitably controlling a motion of a valve by an electric motor.

According to the first aspect of the present invention, there is provided a valve gear of an internal combustion engine converting a rotational motion of an electric motor into a linear motion by a cam, and driving a valve of a cylinder so as to be opened and closed based on the linear motion, comprising: electric motor control means capable of actuating the electric motor in a rocking drive mode in which a rotating direction of the cam is changed during a lift of the valve, wherein the electric motor control means comprises rocking control means for controlling a motion of the electric motor such that the cam starts rotating before the valve starts lifting in the rocking drive mode.

According to the valve gear of the first aspect, an initial speed of the cam at the time of starting the lift becomes higher in comparison with the case of rotating the electric motor from the lift starting position of the valve, so that a lift speed of the valve becomes higher, and a lift amount of the intake valve is increased in an early stage. Accordingly, the time area obtained by integrating the lift amount of the valve is increased, and it is possible to increase an intake efficiency or an exhaust efficiency.

In the valve gear according to the first aspect, the rocking control means may control a rotating speed of the cam in the rocking drive mode such that the rotating speed of the cam at the time of starting the lift of the valve becomes higher than a basic speed obtained by dividing a rotating speed of an engine output shaft of the internal combustion engine by a rotation number of the engine output shaft from a start of an intake stroke to an end of an exhaust stroke. According to this embodiment, it is possible to set the initial speed of the cam at the time of starting the lift to a higher speed in comparison with the case of rotating the cam at a fixed speed in the same direction so as to drive the valve. Accordingly, it is possible to make the lift speed at the time when the valve is opened sufficiently high so as to further expand the time area described above.

In the valve gear according to the first aspect, the rocking control means may alternately use both sides with respect to a nose of the cam so as to lift the valve, by rotating the cam in the same direction until the next change during the lift, after changing the rotating direction of the cam during the lift of the valve. When the cam is actuated in the manner described above, it is possible to reduce a frequency of changing the rotating directions of the cam and the motor, it is possible to prevent an oil film from being disturbed with respect to various parts of a valve gear system due to the stop of the rotation and the change of the rotating direction, thereby improving a lubricating performance. Accordingly, it is possible to suppress a frictional resistance of the valve gear system parts, it is possible to drive the electric motor by a small load, and it is possible to use a compact electric motor having a small rated torque. It is also possible to prevent a biased abrasion of the cam.

According to the second aspect of the present invention, there is provided a valve gear of an internal combustion engine converting a rotational motion of an electric motor into a linear motion by a cam, and driving a valve of a cylinder so as to be opened and closed based on the linear motion, comprising: electric motor control means capable of actuating the electric motor in a forward rotating drive mode in which the cam is continuously rotated in one direction, wherein the electric motor control means comprises forward rotating control means for changing a rotational number of the cam before the valve starts lifting in the forward rotating drive mode so as to change a working angle of the valve. According to the valve gear of the second aspect, it is possible to variously change an intake characteristic or an exhaust characteristic of the internal combustion engine by applying various speeds to the cam at the time of starting the lift, thereby expanding or contracting the working angle.

In the valve gear according to the second aspect, the forward rotating control means may change the rotating speed of the cam to a predetermined speed which is different from a basic speed obtained by dividing a rotating speed of an engine output shaft of the internal combustion engine by a rotation number of the engine output shaft from a start of an intake stroke to an end of an exhaust stroke, before starting the lift of the valve, and rotates the cam at the predetermined speed during the lift of the valve.

In the case of rotating the cam at a high speed in one direction, there is a possibility that the rotating speed of the cam cannot be sufficiently changed due to an inertia during the lift of the valve. In such a case, it is possible to securely achieve a target working angle by accelerating or decelerating the speed of the cam to the predetermined speed before starting the lift, and rotating the cam at the predetermined speed during the lift.

According to the third aspect of the present invention, there is provided a valve gear of an internal combustion engine converting a rotational motion of an electric motor into a linear motion by a cam, and driving a valve of a cylinder so as to be opened and closed based on the linear motion, comprising: electric motor control means capable of actuating the electric motor in each of a forward rotating drive mode in which the cam is continuously rotated in one direction, and a rocking drive mode in which a rotating direction of the cam is changed during a lift of the valve, wherein the electric motor control means comprises changing control means for controlling a motion of the electric motor in at least any one of the rocking drive mode and the forward rotating drive mode such that a time area obtained by integrating a lift amount of the valve approximately coincides between before and after changing the mode, at the time of changing the rocking drive mode and the forward rotating drive mode.

According to the valve gear of the third aspect, since the drive mode of the cam is changed between the rocking drive mode and the forward rotating drive mode in a state in which the time area is approximately coincided, it is possible to prevent the intake efficiency or the exhaust efficiency from being changed between before and after the change, and it is possible to achieve a smooth mode change so as to prevent a drivability from being deteriorated.

In the valve gear according to the third aspect, the changing control means may control the motion of the electric motor in the rocking drive mode such that a maximum lift amount of the valve in the rocking drive mode is increased according to being closer to the changing time of the mode. The maximum lift amount is fixed in the forward rotating drive mode, however, the maximum lift amount can be changed in the rocking drive mode by changing the rotating angle of the cam. Further, the working angle can be optionally set by changing the rotating speed of the cam. Accordingly, it is possible to comparatively easily adjust the time area of the valve in comparison with the forward rotating drive mode so as to coincide with the time area in the forward rotating drive mode.

Further, the changing control means may control an opening degree of a throttle valve of the internal combustion engine such that the opening degree of the throttle valve is reduced according to an increase of the maximum lift amount. In the case of increasing the time area by increasing the maximum lift amount, it is possible to inhibit the intake efficiency or the exhaust efficiency from being changed, by reducing the opening degree of the throttle valve so as to compensate for the increase. In particular, in the case of driving the intake valve, there is an advantage that a pumping loss of the intake can be restricted by increasing the opening degree of the throttle valve while limiting the maximum lift amount small in the rocking drive mode.

BEST MODE FOR CARRYING OUT THE INVENTION

Figure 1:
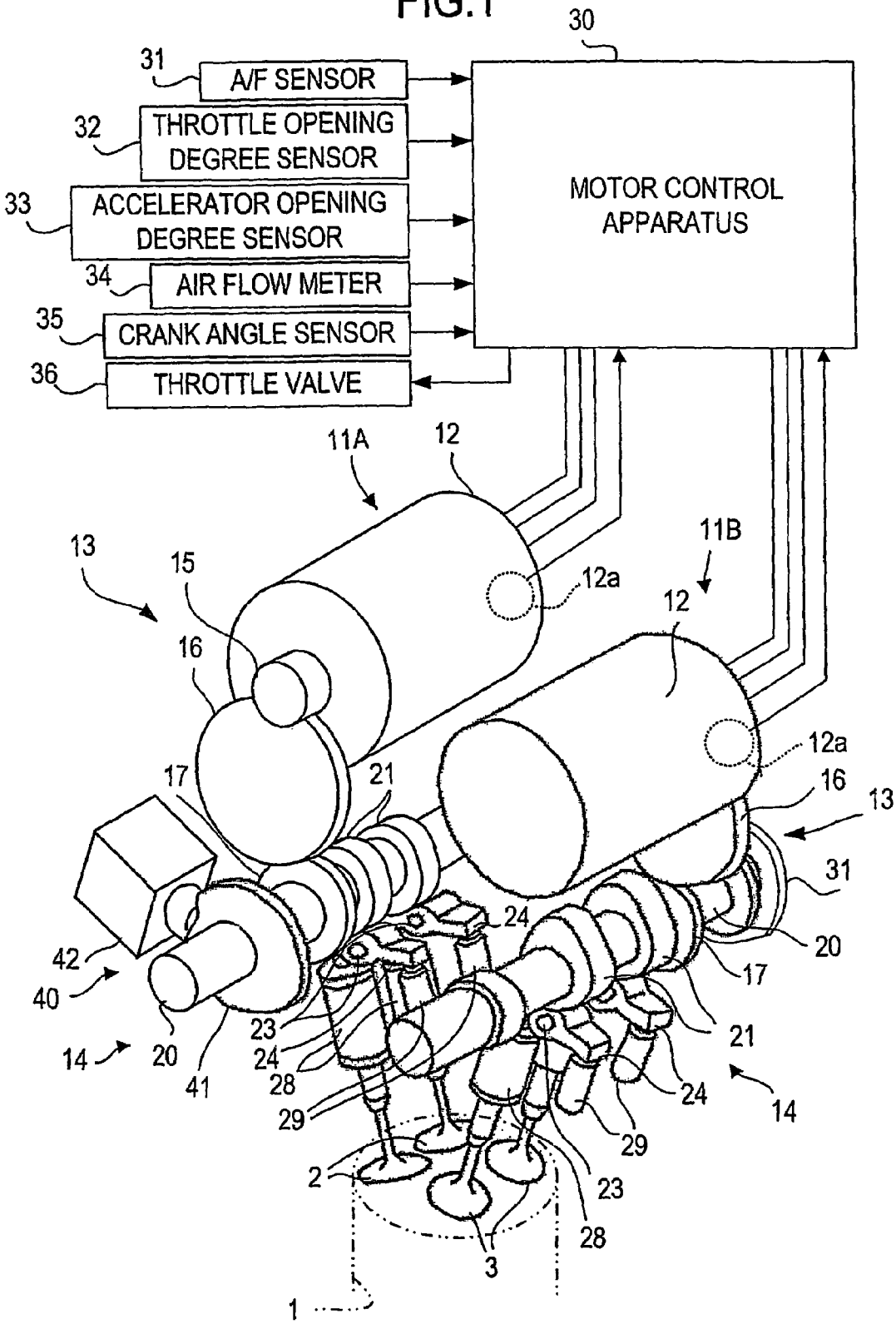
FIG. 1 is a perspective view showing a schematic structure of a valve gear according to the present invention.

FIG. 1 shows an embodiment of a valve gear according to the present invention. Valve gears 11A and 11B in FIG. 1 are installed in a 4-cycle multiple cylinder reciprocal type internal combustion engine. One cylinder 1 of the internal combustion engine is provided with two intake valves 2 and two exhaust valves 3, as valve means for opening and closing the cylinder 1. The two intake valves (valve means) 2 are driven by one valve gear 11A, and the exhaust valves (valve means) 3 are driven so as to be opened and closed by the other valve gear 11B. With regard to the other cylinders (not shown), the intake valves and the exhaust valves are driven so as to be opened and closed by the different valve gears 11A and 11B in the same manner. The valve gear 11A in an intake side and the valve gear 11B in an exhaust side basically have the same structure, and the valve gear 11A in the intake side is explained.

The valve gear 11A in the intake side is provided with an electric motor (hereinafter, refer to as a motor) 12 serving as a drive source, a gear train 13 corresponding to a transfer mechanism for transferring a rotational motion of the motor 12, and a cam mechanism 14 converting the rotational motion transferred from the gear train 13 into a linear opening and closing motion of the intake valve 2. The motor 12 employs a DC brushless motor or the like in which a rotational speed can be controlled. The motor 12 has therein a position detecting sensor 12*a* such as a resolver, a rotary encoder or the like for detecting a rotational position of the motor. The gear train 13 transfers a rotation of a motor gear 15 mounted to an output shaft (not shown) of the motor 12 to a cam driving gear 17 via an intermediate gear 16. The gear train 13 may be structured such that the motor gear 15 and the cam driving gear 17 are rotated at a uniform speed, or may be structured such that a speed of the cam driving gear 17 is increased or reduced with respect to the motor gear 15.

Figure 2:
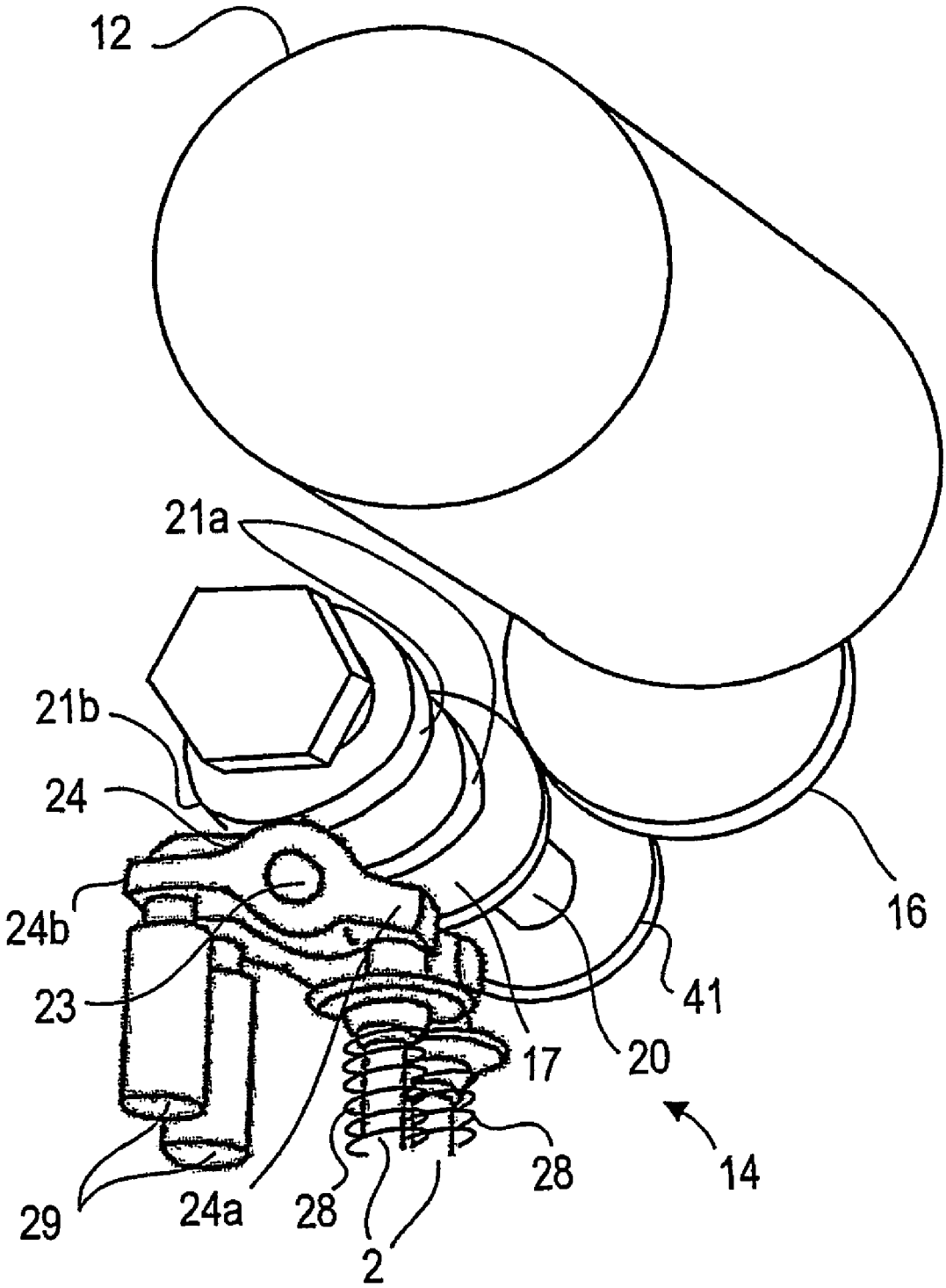
FIG. 2 is a view showing details of a cam mechanism in FIG. 1.

As is also shown in FIG. 2, the cam mechanism 14 is provided with a cam shaft 20 which is provided so as to be coaxially and integrally rotated with the cam driving gear 17, two cams 21 which are provided so as to be integrally rotated with the cam shaft 20, and a pair of rocker arms 24 which are supported so as to be swung around a rocker arm shaft 23 in correspondence to the respective cams 21. The cam 21 is formed as one kind of plate cam in which a nose 21*a* is formed by protruding a part of a circular arc base circle 21*b* coaxially formed with the cam shaft 20 toward an outer side in a radial direction. A profile of the cam 21 is set such that no negative curvature is generated around an entire periphery of the cam 21, that is, a convex curve is formed toward the outer side in the radial direction.

Each of the cams 21 is opposed to one end portion 24*a* of the rocker arm 24. Each of the intake valves 2 is energized to a side of the rocker arm 24 by a compression reaction force of a valve spring 28, whereby the intake valve 2 is closely attached to a valve seat (not shown) of an intake port, and the intake port is closed. Another end portion 24*b* of the rocker arm 24 is in contact with an adjuster 29. The adjuster 29 presses up another end portion 24*b* of the rocker arm 24, the rocker arm 24 is kept in a state in which one end portion 24*a* is in contact with an upper end portion of the intake valve 2.

In the cam mechanism 14 described above, when the rotational motion of the motor 12 is transferred to the cam shaft 20 via the gear train 13, the cam 21 is rotated integrally with the cam shaft 20, and the rocker arm 24 is oscillated around the rocker arm shaft 23 in a fixed range during a period that the nose 21*a* gets over the rocker arm 24. Accordingly, one end portion 24*a* of the rocker arm 24 is pressed down, and the intake valve 2 is driven so as to be opened and closed against the valve spring 28.

A torque reduction mechanism 40 is provided in the valve gear 11A. The torque reduction mechanism 40 is provided for reducing a torque applied to the cam mechanism 14 based on a force which the valve spring 28 presses back the intake valve 2 in a closing direction (hereinafter, such torque is called as a valve spring torque). The torque reduction mechanism 40 is provided with an inverse phase cam 41 which can be integrally rotated with the cam shaft 20, and a torque applying apparatus 42 which is arranged so as to oppose to the inverse phase cam 41. On the inverse phase cam 41, there is formed a cam surface having a shape based on the valve spring torque, and to the cam surface, a complementary force having an inverse phase opposite to that of the valve spring torque is applied from the torque applying apparatus 42, whereby the valve spring torque applied to the cam mechanism 14 can be cancelled.

As shown in FIG. 1, the motion of the motor 12 of each of the valve gears 11A and 11B is controlled by a motor control apparatus 30 serving as electric motor control means. The motor control apparatus 30 is a computer unit provided with a micro processor and peripheral devices such as a main storage device or the like required for a motion of the micro processor. The motor control apparatus 30 controls the motion of each of the motors 12 according to a valve control program stored in the ROM thereof. Incidentally, FIG. 1 shows the valve gears 11A and 11B of one cylinder 1, however, the motor control apparatus 30 may be shared with the valve gears 11A and 11B of the other cylinder 1. The motor control apparatus 30 may be provided each of the cylinders 1 or each of the valve gears. The motor control apparatus 30 may be provided for exclusively controlling the valve gears 11A and 11B, or may be used together with the other intended use. For example, an engine control unit (ECU) for controlling a fuel injection amount of the internal combustion engine may be used as the motor control apparatus.

To the motor control apparatus 30, there are connected, as information input means, an A/F sensor 31 outputting a signal in correspondence to an air fuel ratio of exhaust gas, a throttle opening degree sensor 32 outputting a signal in correspondence to an opening degree of a throttle valve adjusting an intake amount, an accelerator opening degree sensor 33 outputting a signal in correspondence to an opening degree of an accelerator pedal, an air flow meter 34 outputting a signal in correspondence to the intake amount, a crank angle sensor 35 outputting a signal in correspondence to an angle of a crank shaft, and the like. Incidentally, a value determined based on a predetermined function expression or a map may be used for controlling the motor 12 in place of actual measurement values by these sensors. Further, an output signal of a position detecting sensor 12*a* installed in the motor 12 is also input to the motor control apparatus 30.

Figure 3:
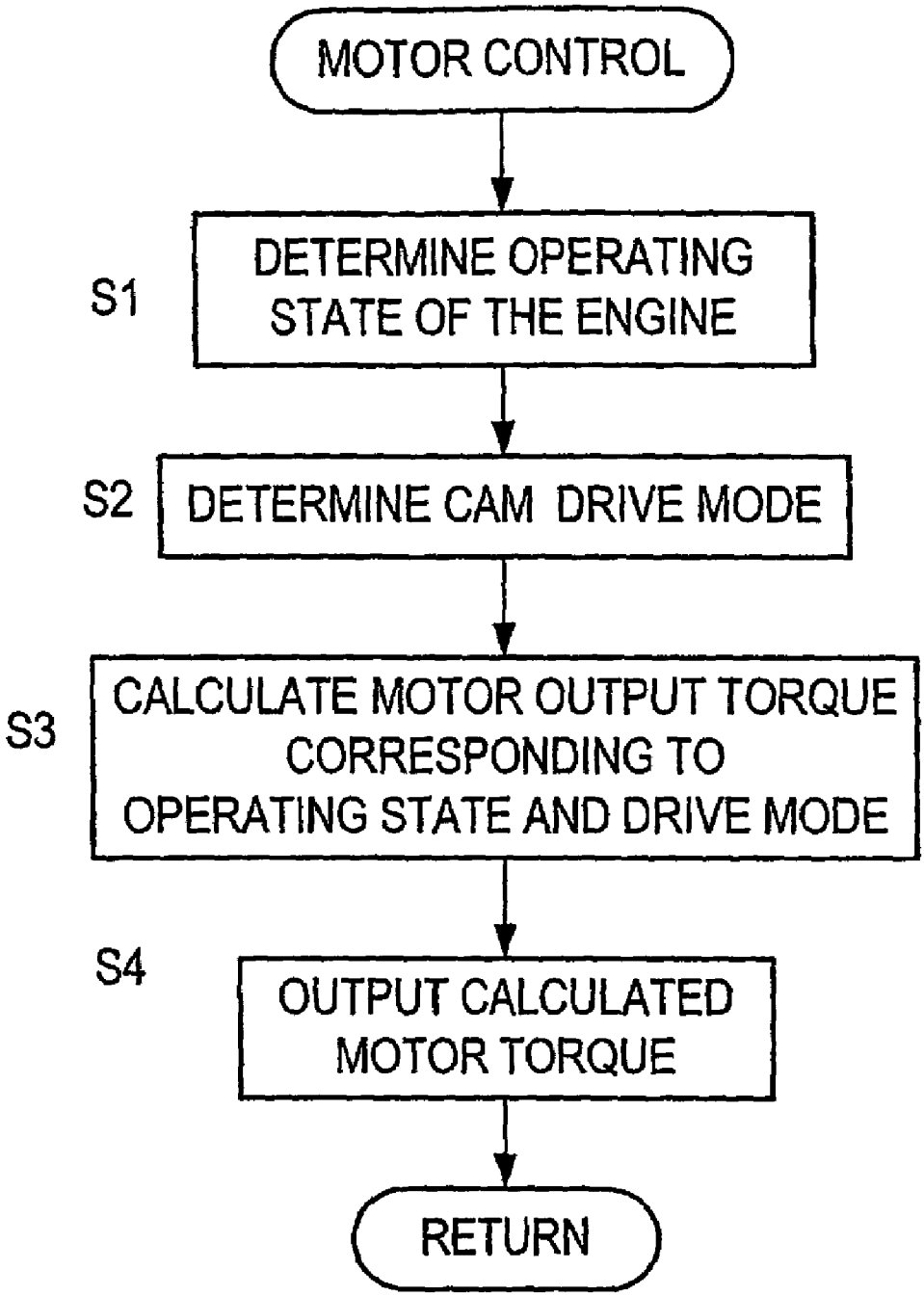
FIG. 3 is a flow chart showing an outline of a motor control routine executed by a motor control apparatus in FIG. 1.

Next, a control of the motor 12 executed by the motor control apparatus 30 is explained. In this case, the control of the motor 12 for driving the intake valve 2 of one cylinder 1 is explained, however, the same matter is applied to the control of the motor 12 for driving the other intake valve 2. FIG. 3 shows a motor control routine which the motor control apparatus 30 executes for controlling the output torque of the motor 12. In this motor control routine, the motor control apparatus 30 first determines an operating state of the internal combustion engine with referring to the output of each of the sensors 31 to 35 in step S1, and determines the drive mode of the cam 21 with respect to the intake valve 2 in the following step S2.

Figure 4A:
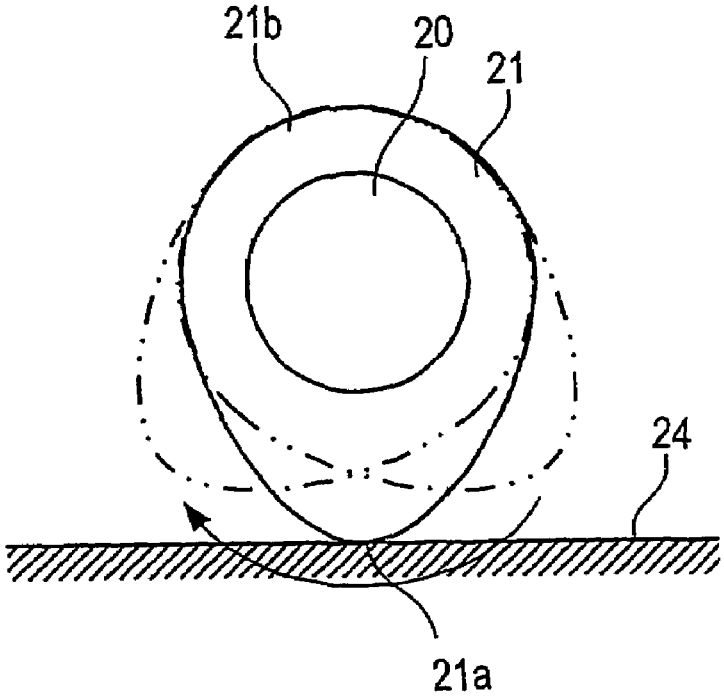
FIGS. 4A and 4B are views showing a motion of a cam in a forward rotating drive mode and a rocking drive mode, respectively.
Figure 4B:
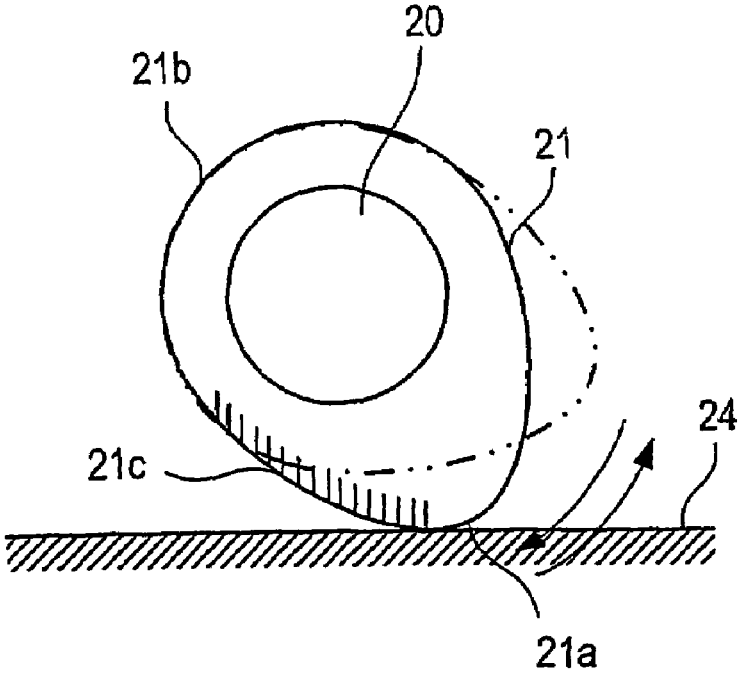

The drive mode of the cam 21 includes a forward rotating drive mode of continuously rotating the motor 12 in one direction so as to continuously rotate the cam 21 in a forward rotating direction (a direction of an arrow in the drawing) over a maximum lift position, that is, a position at which the nose 21*a* of the cam 21 is in contact with an opposite side part (the rocker arm 24 in this case), as shown in FIG. 4A, and a rocking drive mode of changing the rotating direction of the motor 12 in the middle of the lift of the intake valve 2 (in the middle of opening the cylinder 1) so as to reciprocate the cam 21 as shown in FIG. 4B. Incidentally, the rotating direction of the cam 21 in the rocking drive mode is changed before the cam 21 reaches the maximum lift position in the forward rotating drive mode.

Figure 5:
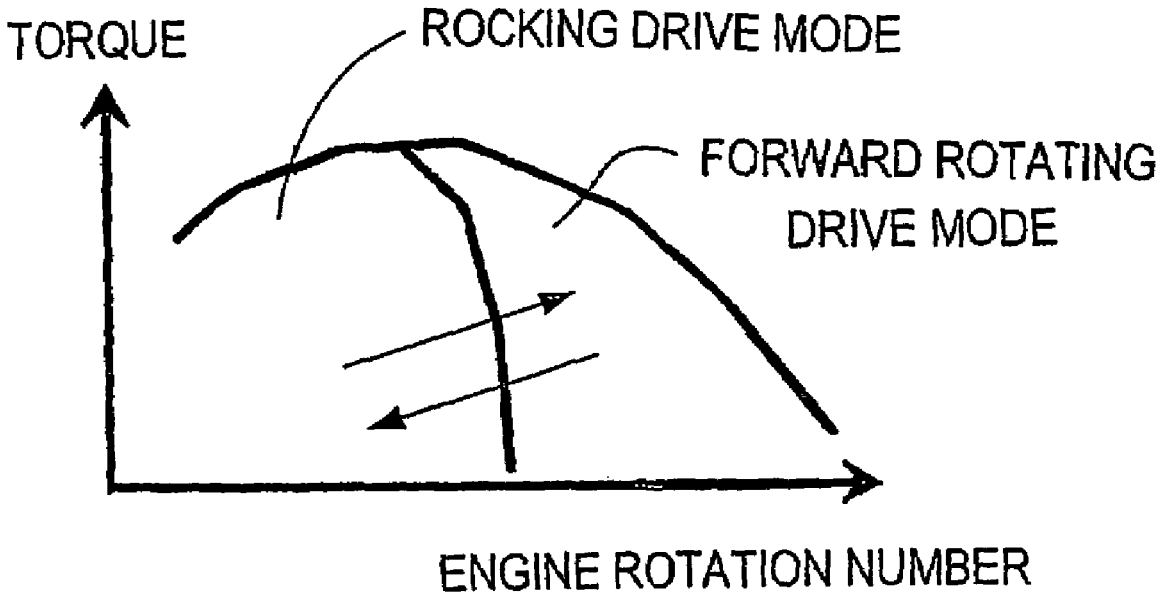
FIG. 5 is a graph showing an applied region of each of the drive modes of the cam.

Further, the drive mode of the cam 21 is properly used in association with a rotation number and an output torque of the internal combustion engine, for example, as shown in FIG. 5. In FIG. 5, the rocking drive mode is basically selected in a low rotating region, and the forward rotating drive mode is basically selected in a high rotating region, however, the rotation number in the boundary of both the modes is adjusted so as to be biased to the low rotating side as the output torque of the internal combustion engine becomes higher. In step S2 in FIG. 3, the engine rotation number is determined based on the output of the crank angle sensor 35, the output torque is estimated based on the throttle opening degree detected by the throttle opening degree sensor 32 and the intake amount detected by the air flow meter 34, and the mode in correspondence to the obtained engine rotation number and the output torque is sufficiently determined based on a map in FIG. 5 (actually a data of the map stored in the ROM).

After determining the drive mode in step 2, the routine is proceeded to step S3 where the motor output torque is arithmetically operated (calculated) in correspondence to the operating state of the internal combustion engine and the drive mode of the cam 21. For example, a valve gear characteristic (a phase and a working angle) to be applied to the intake valve 2 is determined based on the operating state of the internal combustion engine, and the output torque of the motor 12 necessary for realizing the determined valve gear characteristic is arithmetically operated. In step S3, the valve gear characteristic of the intake valve 2 and the output torque of the motor 12 may be determined by covering a proper period. For example, four strokes comprising intake, compression, expansion and exhaust strokes in the internal combustion engine may be corresponded to arithmetic operation cycles of the control routine in FIG. 3, and the valve gear characteristic and the output torque may be determined in each of the arithmetic operation cycles. In this case, the output torque with respect to the motor 12 can be renewed in correspondence to the operating state of the internal combustion engine every time when four strokes are finished, by repeatedly executing the control routine in FIG. 3.

The output torque of the motor 12 can be determined based on the valve gear characteristic of the intake valve 2 as described below. If the valve gear characteristic to be applied to the intake valve 2 is determined, a relationship between the crank angle and the lift amount of the intake valve 2 is univocally determined according to the valve gear characteristic, and the corresponding relationship between the lift speed and the crank angle to be applied to the intake valve 2 is determined by differentiating the lift amount. Since the lift speed of the intake valve 2 can be replaced by the rotating speed of the cam shaft 20 based on a cam profile of the cam 21, the corresponding relationship between the rotating speed and the crank angle to be applied to the cam shaft 20 can be univocally determined based on the valve gear characteristic of the intake valve 2 if the valve gear characteristic of the intake valve 2 is determined. In this case, the corresponding relationship between the lift speed of the intake valve 2 and the rotating speed of the cam shaft 20 is different according to the drive mode of the cam 21, however, details thereof will be described later.

It is preferable to determine the acceleration which the motor 12 should apply to the cam shaft 20, by differentiating the rotating speed obtained in the manner described above, and arithmetically operate the output torque of the motor 12 necessary for obtaining the acceleration. Incidentally, if the output torque of the motor 12 is determined while taking into consideration an inertia torque applied from the various valve gear system parts (the rocker arm 24 and the like) reciprocating in synchronous with the intake valve 2, a control accuracy is improved preferably. Since the inertia torque affects largely at the high rotating time when the lift speed and acceleration of the intake valve 2 are increased, it is desirable to take the torque influence into consideration in the forward rotating drive mode which is particularly selected at the high rotating time. On the contrary, in the rocking drive mode selected at the low rotating time, the output torque of the motor 12 may be determined without regarding to the inertia torque.

After arithmetically operating the output torque of the motor 12 in step S3 in FIG. 3, the routine is proceeded to step S4 where the arithmetically operated torque is output as a torque command value to the drive circuit (not shown) of the motor 12. The routine is temporarily finished after the output, and the routine in FIG. 3 is restarted in wait for starting the next arithmetic operation cycle. The drive circuit which receives the torque command from the motor control apparatus 30 controls a current to be supplied to the motor 12 in the next drive cycle according to the torque command. Accordingly, the intake valve 2 is driven so as to be opened and closed based on the characteristic which is suitable for the operating state of the internal combustion engine.

Figure 6:
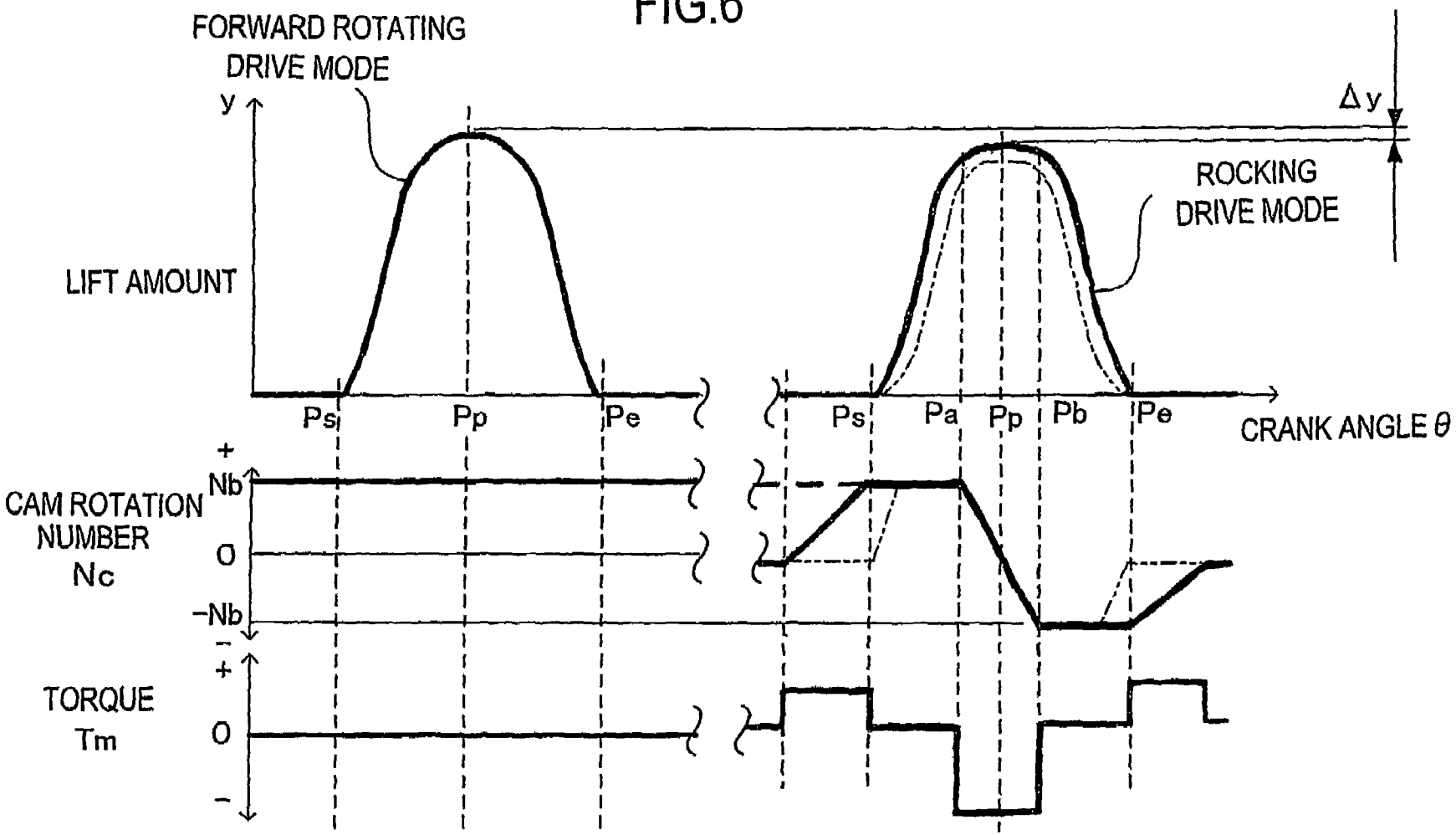
FIG. 6 is a diagram showing a corresponding relationship of a crank angle, a lift amount of an intake valve, a rotation number of the cam and an output torque of a motor, in the forward rotating drive mode and the rocking drive mode.

Next, various aspects concerning the motion control of the cam 21 by the valve gear 11A will be explained with reference to FIGS. 6 to 16. FIG. 6 shows a corresponding relationship of the crank angle θ, the lift amount y of the intake valve 2, the rotating speed (sometimes called as the rotation number) Nc of the cam 21, and the output torque Tm of a motor 12, in each of the forward rotating drive mode and the rocking drive mode. There is shown that the lift amount y is increased in the opening direction with being closer to the upper side. The cam rotation number is increased in the forward rotating direction with being closer to the upper side from a position where the cam rotation number Nc=0. The torque Tm corresponds to the torque Tm=0 in a horizontal axis, and is increased in the forward rotating direction with being closer to the upper side.

(Basic Control in Forward Rotating Drive Mode)

In the forward rotating drive mode shown in FIG. 6, the cam 21 is rotated at a basic speed Nb, that is, a rotating speed corresponding to one half of a rotating speed of the crank (it may be called as a crank rotation number). Namely, the basic speed is defined, in this embodiment, as a speed obtained by dividing the rotating speed of the crank shaft by a rotation number of the crank shaft during a period from a start of an intake stroke to an end of the exhaust stroke. In the 4-cycle reciprocating type internal combustion engine, such rotation number of the crank shaft corresponds to two. At this time, the cam 21 is driven by the motor 12, however, since the valve spring torque applied to the cam 21 is cancelled by the torque reduction mechanism 40, the output torque Tm of the motor 12 becomes approximately 0. A change of the lift amount y of the intake valve 2 obtained in the manner described above is, for example, equal to a change of the lift amount obtained in the case of mechanically driving the crank shaft and the cam shaft 20 via a transmission mechanism having a speed reduction ratio of 1/2.

(Control in Rocking Drive Mode)

On the other hand, in the rocking drive mode, the rotation of the cam 21 is started from a stage prior to a lift start position Ps, and the rotation number Nc of the cam 21 is increased up to the basic speed Nb at the lift start position Ps. In other words, the driving of the cam 21 is started before starting the lift such that the initial speed of the cam 21 at the lift start position Ps coincides with the basic speed Nb. Thereafter, the cam 21 is forward rotated at the basic speed Nb for a while, the rotation number Nc of the cam 21 is reduced at a first switch position Pa which is earlier than a maximum lift position Pp, the cam 21 is set to a temporary stop state having the rotation number Nc=0 at the maximum lift position Pp, then the rotating direction of the cam 21 is changed to an inverse rotating direction, and thereafter the rotating speed is gradually increased. Further, the cam 21 is rotated at the basic speed Nb in the inversed direction from the second switch position Pb where the rotation number of the cam 21 in the inverse direction reaches the basic speed Nb to a lift end position Pe, a speed reduction of the cam 21 is started at the lift end position Pe, and the cam 21 is thereafter stopped. It is possible to coincide the corresponding relationship between the crank angle and the lift amount with that in the forward rotating drive mode from the lift start position Ps of the cam 21 to the switch position Pa, and from the change position Pb to the lift end position Pe, by applying the motion described above to the cam 21. In the rocking drive mode in FIG. 6, since the cam 21 is driven at the low speed, the inertia torque may be disregarded. In this case, the output torque of the motor 21 draws a wave form which is increased in proportion to the crank angle during the acceleration of the cam 21, and is reduced in proportion to the crank angle during the deceleration of the cam 21.

In the rocking drive mode in FIG. 6, since the deceleration of the cam 21 is started before reaching the maximum lift position Pp, the lift amount of the intake valve 2 at the maximum lift position Pp becomes somewhat smaller than that in the forward rotating drive mode. In this case, a difference by of the lift amount becomes smaller than a comparative example shown by an imaginary line in FIG. 6, that is, an example that the control is executed such as to start the drive of the cam 21 from the lift start position Ps and stop the cam 21 at the lift end position Pe. Further, in comparison with the comparative example, a characteristic diagram of the lift amount of the intake valve 2 is laterally expanded on the boundary of the maximum lift position Pp, so that the time area with respect to the lift motion of the intake valve 2 is increased. Accordingly, in spite that the maximum lift amount is reduced from that at the time of the forward rotating drive mode, it is possible to sufficiently secure the time area so as to prevent deterioration of a filling efficiency of the intake air with respect to the cylinder 1. Incidentally, the time area corresponds to an area in a range surrounded by the horizontal axis showing the crank angle and a curve showing the change of the lift amount, and is obtained by integrating the lift amount.

Figure 7:
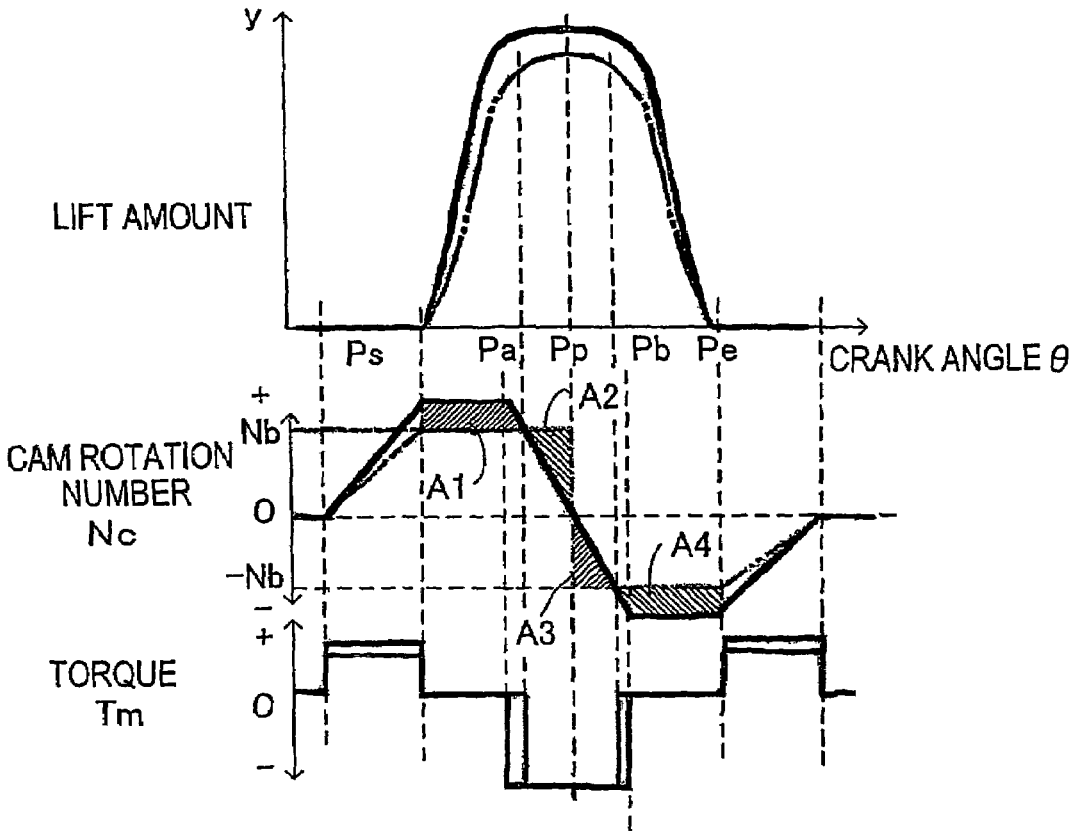
FIG. 7 is a diagram showing the other example of a cam control in the rocking drive mode.

FIG. 7 shows an example of driving the cam 21 at a fixed speed higher than the basic speed Nb, from the lift start position Ps to the first switch position Pa, and from the second switch position Pb to the lift end position Pe. For the purpose of comparison, the wave form in the rocking drive mode in FIG. 6 is shown by an imaginary line. Since the maximum speed of the cam 21 is set as the basic speed Nb in the rocking drive mode in FIG. 6, the maximum lift amount becomes smaller in comparison with the forward rotating drive mode if the working angle (the crank angle between the position Ps and Pe) is fixed. However, according to the example in FIG. 7, the lift speed of the intake valve 2 becomes higher than that at the forward rotating drive mode in FIG. 6, so that it is possible to make the maximum lift amount to coincide with that at the forward rotating drive mode while making the working angle in the rocking drive mode to coincide with the working angle in the forward rotating drive mode. Incidentally, if the rotation number of the cam 21 is set in such a manner that areas of two hatched regions A1 and A2 generated between the lines showing the rotation number of the cam 21 and the basic speed are equal to each other from the lift start position Ps in FIG. 7 to the maximum lift position Pp, and that areas of two hatched regions A3 and A4 generated between the lines showing the rotation number of the cam 21 and the basic speed (in this case, in the inverse direction) are equal to each other from the maximum lift position Pp to the lift end position Pe, it is possible to make the time area with respect to the lift amount of the intake valve 2 to completely coincide with that at the forward rotating drive mode.

Figure 8:
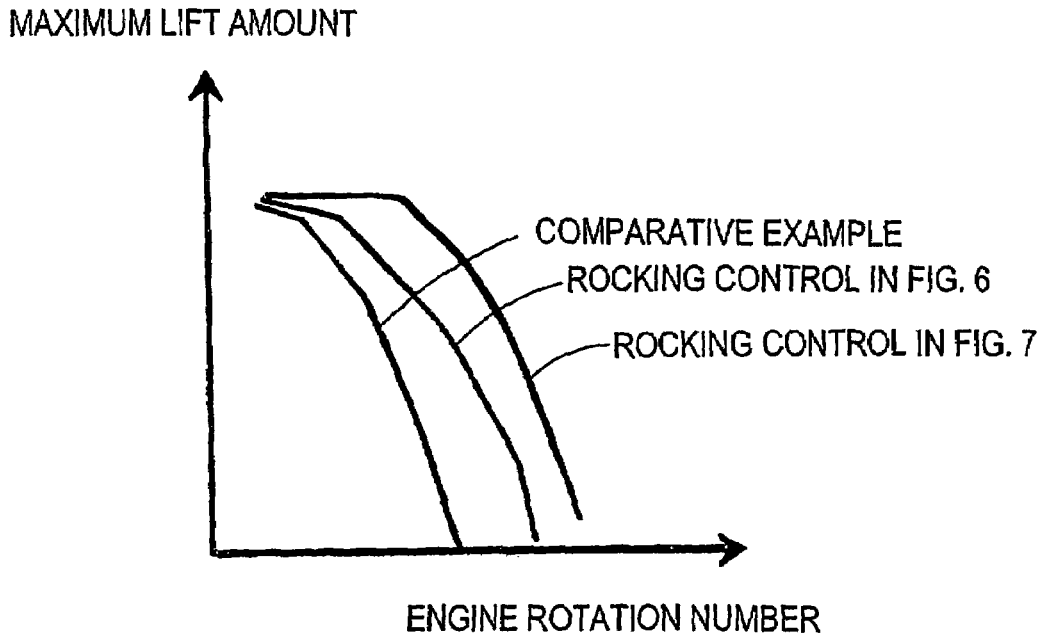
FIG. 8 is a graph showing a limit of a maximum lift amount obtained by the rocking drive mode in FIGS. 6 and 7 in correspondence to a rotation number of an internal combustion engine.

FIG. 8 is a graph showing a corresponding relationship between the maximum lift amount 2 obtained by executing the cam control at the time of the rocking drive mode in FIGS. 6 and 7 and the engine rotation number, together with the case of the comparative example shown by the imaginary line in FIG. 6. As is apparent from FIG. 8, there is a tendency that if the engine rotation speed is increased over a certain limit in the rocking drive mode, a response of the control is insufficient and the maximum lift amount is rapidly lowered, however, according to the examples in FIGS. 6 and 7, it is possible to reduce the lowering tendency in comparison with the comparative example, and it is particularly possible to apply the rocking drive mode to the high rotating region by executing the control in FIG. 7. The motor control apparatus 30 serves as the rocking control means according to the present invention, by controlling the cam 21 in the manner shown in FIG. 6 or 7.

(Control in Forward Rotating Drive Mode)

Next, the control of the cam 21 in the forward rotating drive mode will be explained with reference to FIG. 9. In the forward rotating drive mode in FIG. 6, the cam 21 is continuously driven at the basic speed, however, the working angle of the intake valve 2 can be appropriately changed by changing the speed of the cam 21 in the middle of the lift. In the example shown in FIG. 9, the acceleration of the cam 21 is started earlier than the lift start position Ps so as to make the initial speed of the cam 21 at the lift start position Ps to coincide with the basic speed Nb, the acceleration is continued in the middle of the lift until the cam 21 reaches a predetermined speed higher than the basic speed Nb, the cam 21 is thereafter rotated at a predetermined constant speed, and the cam 21 is decelerated at a proper timing after the maximum lift is obtained, thereby moving the lift end position Pe of the intake valve 2 to an earlier position than the case of the basic control example (an imaginary line in the drawing) shown in FIG. 6. Accordingly, the working angle is reduced in comparison with the case in FIG. 6. Since the cam 21 is forward rotated at a speed higher than the basic speed Nb in the middle of the lift of the intake valve 2, it is necessary to drive the cam 21 at a speed lower than the basic speed Nb during the period from the lift end position Pe to the next lift start position Ps. In this case, since the base circle 21*b* slips on the rocker arm 24 or the base circle 21*b* is apart from the rocker arm 24 during this period, the motion of the intake valve 2 is not affected even by driving the cam 21 at the lower speed than the basic speed Nb. At this time, since the torque is required in the motor 12 at the time of accelerating and decelerating the cam 21, the output torque of the motor 12 becomes a wave form as shown in FIG. 9.

Figure 9:
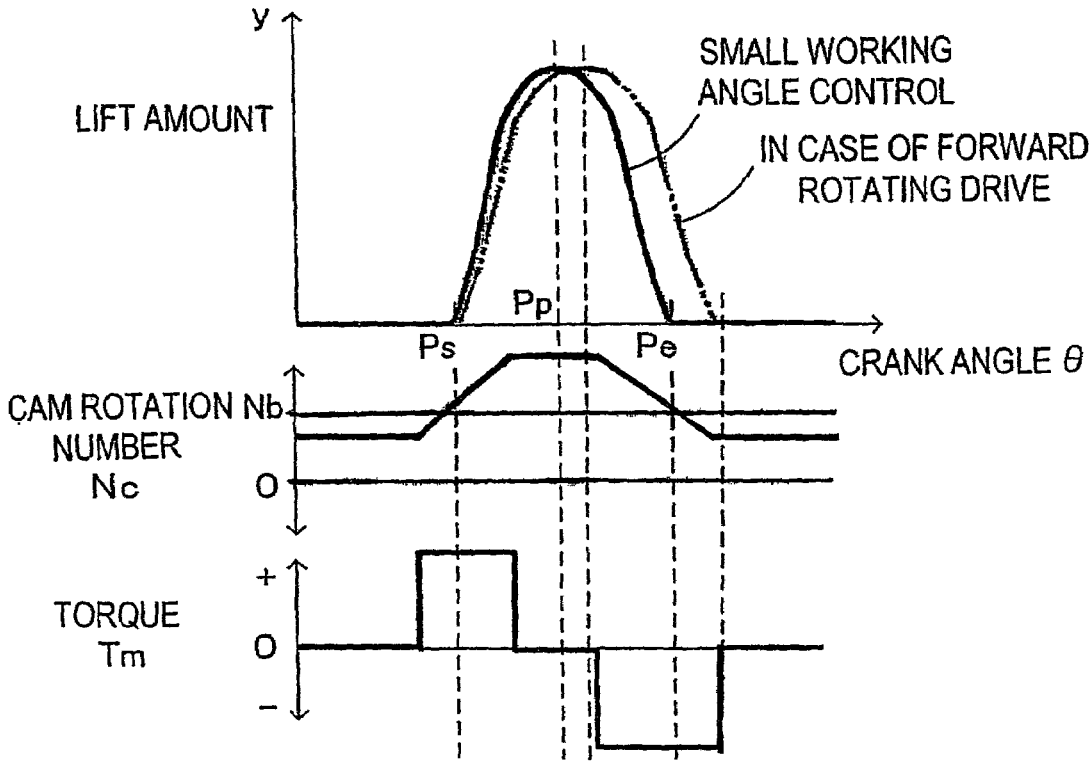
FIG. 9 is a diagram showing the other example of the corresponding relationship of the crank angle, the lift amount of the intake valve, the rotation number of the cam and the output torque of the motor, in the forward rotating drive mode.
Figure 10:
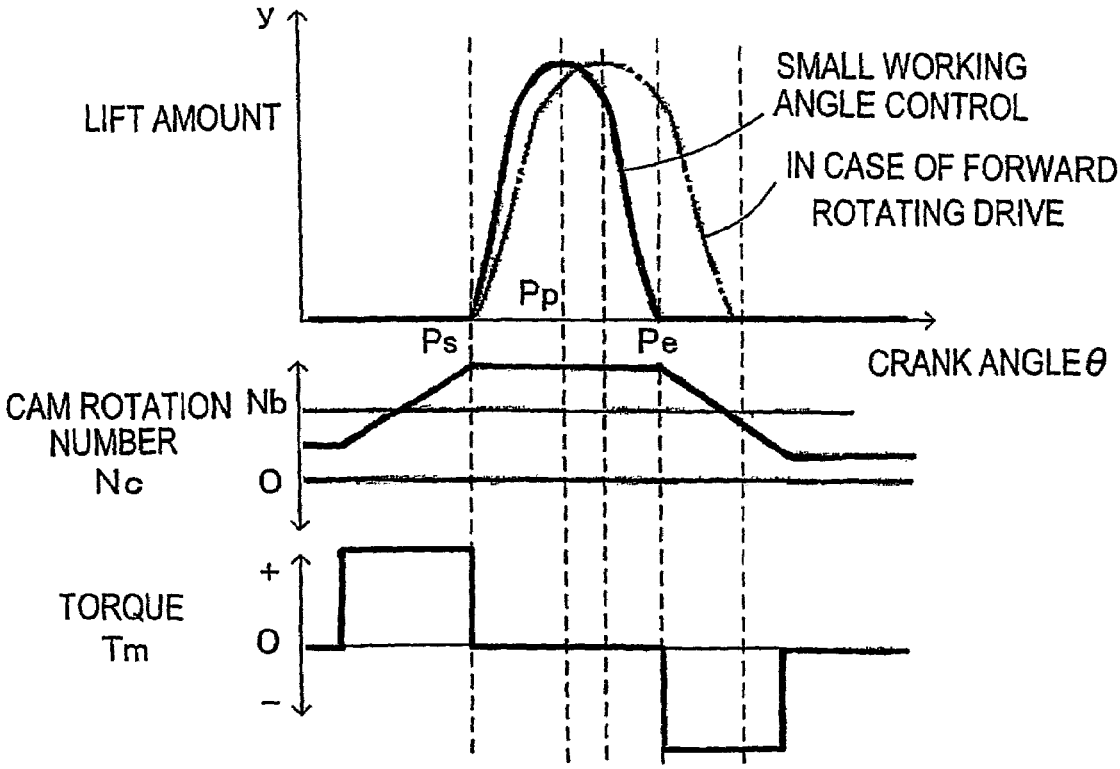
FIG. 10 is a diagram showing an example that the cam is actuated such that the working angle is further reduced with respect to FIG. 9.

FIG. 10 shows the other example of the control of the cam 21 in the forward rotating drive mode. Incidentally, an imaginary line in FIG. 10 shows an example of the forward rotating drive mode in FIG. 6. In the control in FIG. 10, the acceleration of the cam 21 is finished until the lift start position Ps, and the initial speed of the cam 21 at the lift start position Ps is made to coincide with a predetermined speed higher than the basic speed Nb. Further, the cam 21 is maintained at the predetermined speed from the lift start position Ps to the lift end position Pe, and the deceleration of the cam 21 is started from the lift end position Pe. Since the response is deteriorated due to the influence of the inertia of the valve gear system parts when the cam 21 is accelerated or decelerated in the middle of the lift of the intake valve 2 as shown in FIG. 9, the change amount of the speed of the cam 21 cannot be set very large, and the adjusting range of the working angle of the intake valve 2 is limited to a comparatively narrow range. However, if the acceleration and the deceleration of the cam 21 are executed only while the base circle 21*b* of the cam 21 opposes to the rocker arm 24 as shown in FIG. 10, and the cam 21 is driven at a fixed speed during the lift, it is possible to restrict the influence of the inertia, and it is possible to adjust the working angle of the intake valve 2 in a wider range.

Figure 11:
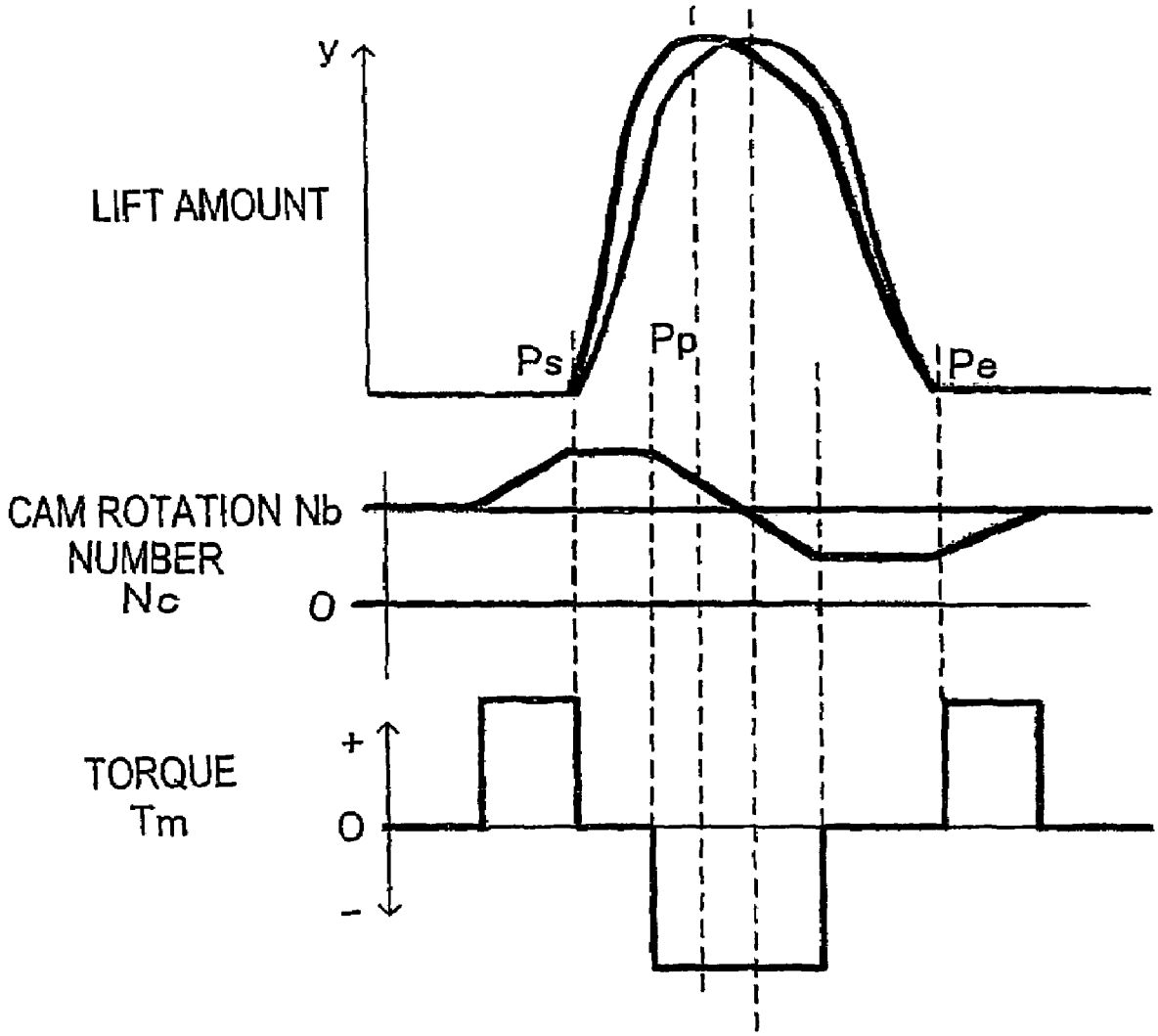
FIG. 11 is a diagram showing an example that the cam speed is set asymmetrically with respect to the maximum lift position.

As described above, the motor control apparatus 30 serves as the forward rotation control means according to the present invention, by controlling the motor 12 as shown in FIG. 9 or 10. The forward rotation control means according to the present invention is not limited to the structure which actuates the cam 21 so as to reduce the working angle. The working angle can be expanded in comparison with the case in FIG. 6 by decelerating the cam 21 before starting the lift and accelerating the cam 21 after finishing the lift. Further, in FIGS. 9 and 10, the lift amount of the cam 21 is symmetrically changed with respect to the maximum lift position Pp, however, the structure is not limited to such configuration, and the structure may be, for example, as shown in FIG. 11, such that the lift amount of the intake valve 2 is asymmetrically changed with respect to the maximum lift position Pp, by changing the speed of the cam 21 asymmetrically before and after the maximum lift position Pp. In this connection, in the example in FIG. 11, there is applied the lift characteristic such that the intake valve 2 is opened at a high speed and is closed at a comparatively low speed, by setting the rotating speed of the cam 21 in the process of opening of the intake valve 2 higher than the rotating speed of the cam 21 in the process of closing of the intake valve 2.

(Control at the Time of Changing Mode)

Figure 12:
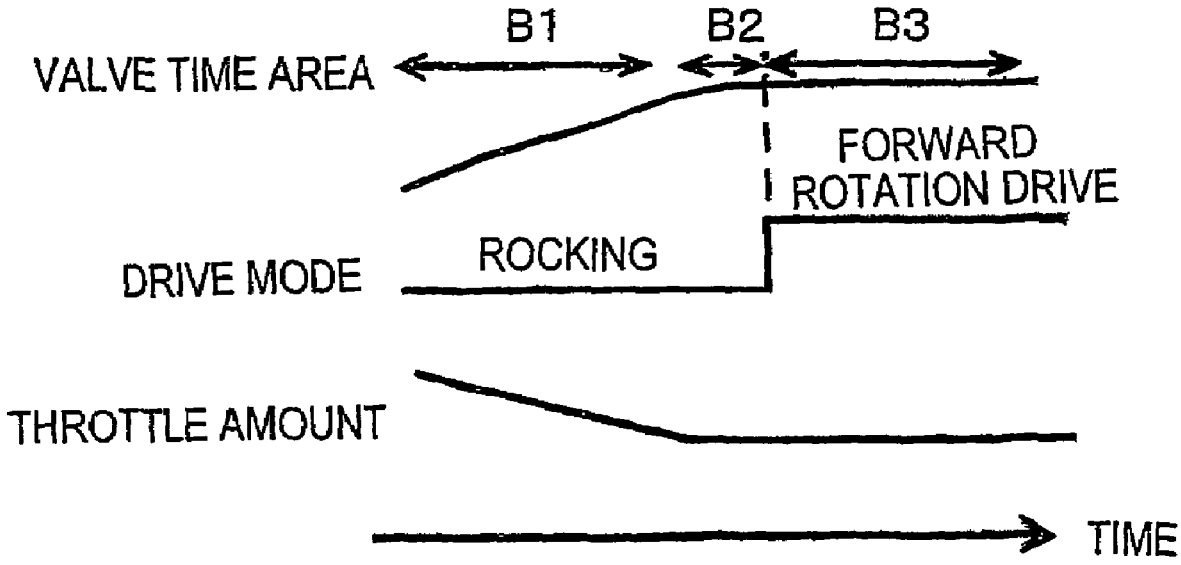
FIG. 12 is a diagram showing a corresponding relationship of the time area of the intake valve, the drive mode of the cam and a throttle amount at the time of changing between the rocking drive mode and the forward rotating drive mode.

Next, a preferable control of the cam 21 at the time of changing the forward rotating drive mode and the rocking drive mode with each other will be explained with reference to FIGS. 12 to 14. The motor control apparatus 30 serves as the changing control means according to the present invention, by executing a control described below. In FIG. 5 described above, any one of the forward rotating drive mode or the rocking drive mode is selected based on the rotation number and the output torque of the internal combustion engine. However, since the lift characteristic (particularly, the maximum lift amount) applied to the intake valve 2 is different in both the modes, there is a possibility that the intake amount is discontinuously changed by the influence at the time when the drive mode of the cam 21 is changed, thereby affecting a drivability. Accordingly, as shown in FIG. 12, the throttle amount is gradually reduced as well as the time area (the valve time area) of the intake valve 2 is gradually increased (a section B1) at the time of changing the control of the cam 21 from the rocking drive mode to the forward rotating drive mode, the valve time area is made to coincide with that in the forward rotating drive mode (a section B2), and the change to the forward rotating drive mode is thereafter executed (a section B3). In specific, the following control is preferable.

Figure 13:
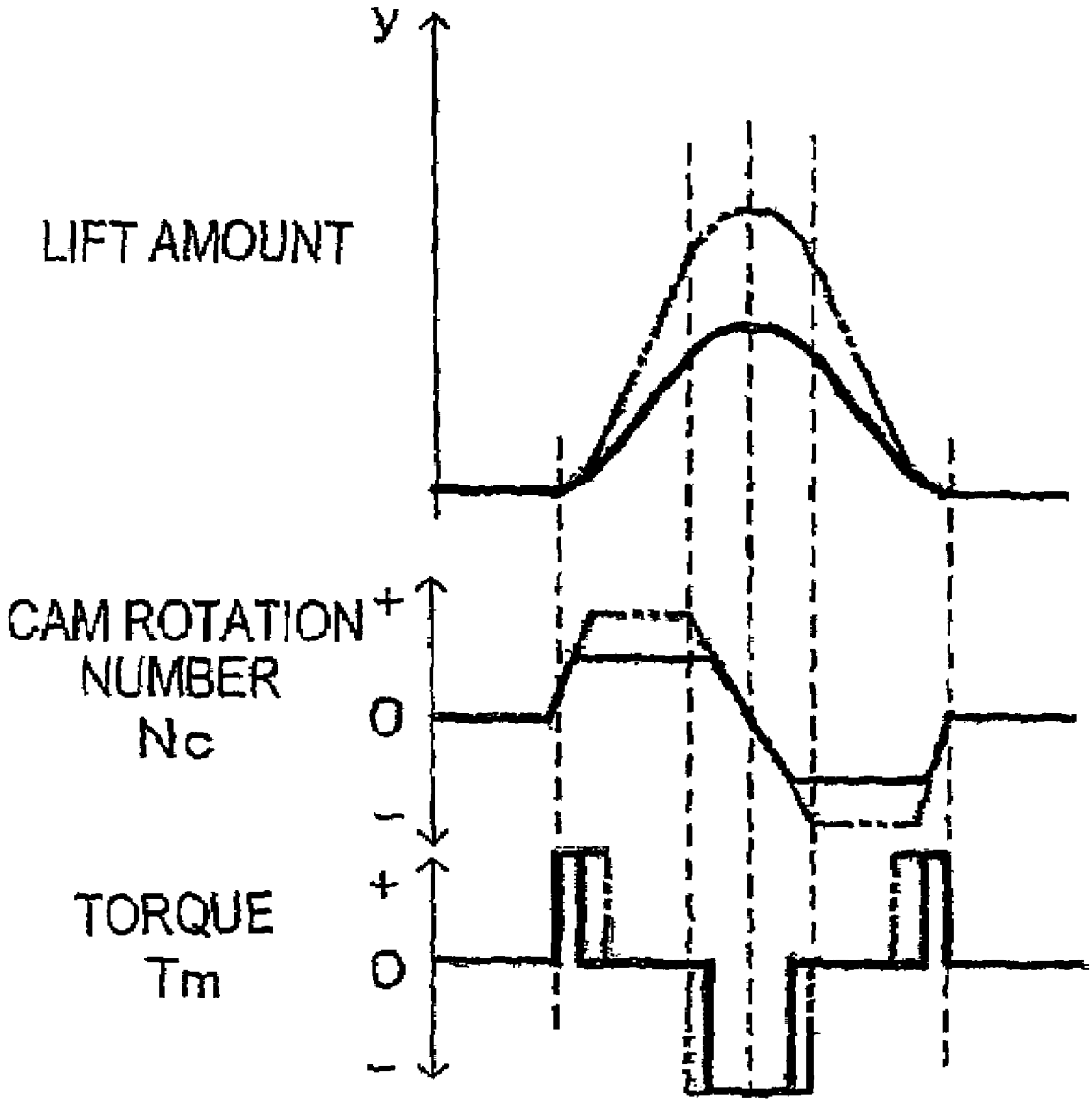
FIG. 13 is a diagram showing a corresponding relationship of the crank angle, the lift amount of the intake valve, the rotation number of the cam and the output torque of the motor, in a section B1 in FIG. 12.
Figure 14:
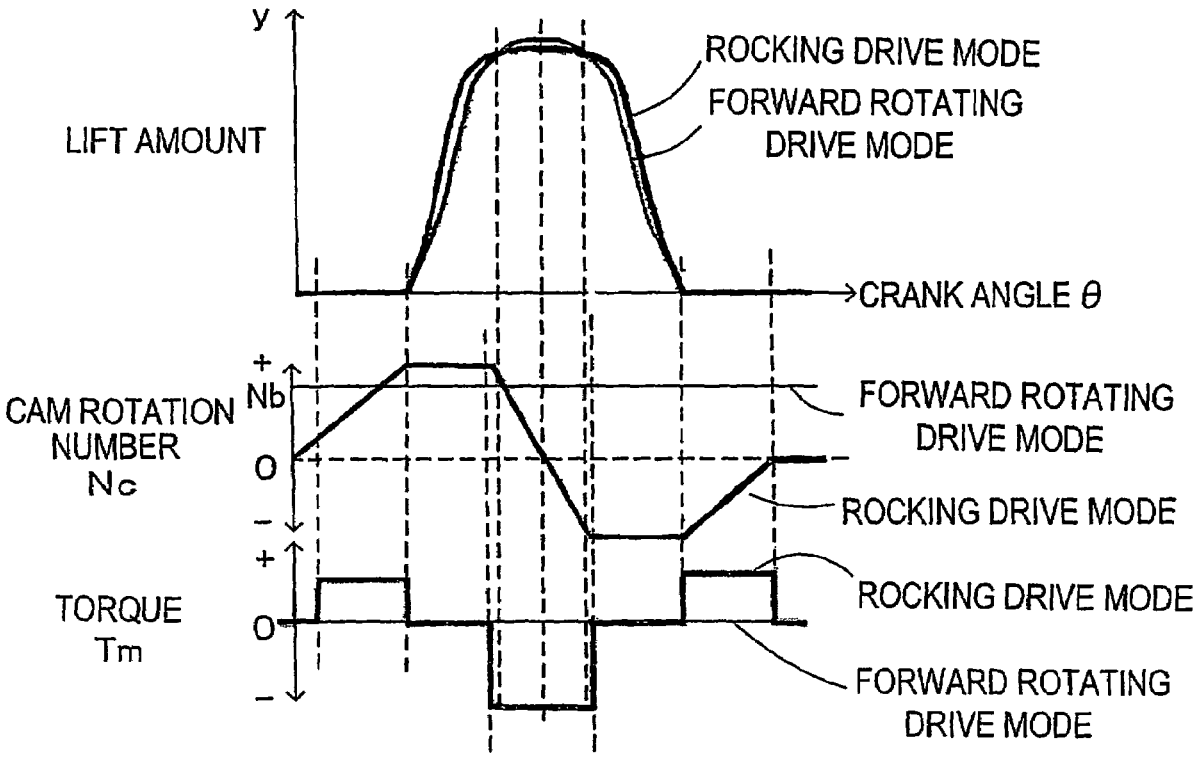
FIG. 14 is a diagram showing a corresponding relationship of the crank angle, the lift amount of the intake valve, the rotation number of the cam and the output torque of the motor, in a section B2 in FIG. 12.

When the lift characteristic at the time of applying the maximum lift amount which is realizable in the rocking drive mode is as shown by an imaginary line in FIG. 13, and when the rocking drive mode is selected, the cam 21 is first rocked such that the lift characteristic in which the maximum lift amount is limited to be small is obtained as shown by a solid line in the drawing. In this case, since the time area of the intake valve 2 is reduced, the opening degree of the throttle valve 36 is increased by applying the opening command to the throttle valve 36 (refer to FIG. 1) from the motor control apparatus 30. Accordingly, it is possible to reduce a pumping loss when the throttle valve 36 is controlled to a small opening degree. When the other computer which controls the throttle opening degree exists, the control of the throttle valve 36 by the motor control apparatus 30 may be realized by applying a command for increasing the throttle opening degree to that computer.

When the control is changed from the state in which the lift amount is limited to the forward rotating drive mode as described above, the lift amount is increased gradually toward a lift characteristic shown by an imaginary line in FIG. 13, whereby the valve time area is gradually increased as shown in FIG. 12. The opening degree (the throttle amount) of the throttle valve 36 is reduced in synchronous with the operation, thereby restricting the change of the intake amount. Further, as shown in FIG. 14, the time area of the intake valve 2 in the rocking drive mode is made to coincide with that in the forward rotating drive mode, and the change to the forward rotating drive mode is thereafter executed. According to the control described above, it is possible to change the drive mode of the cam 21 without discontinuously changing the intake amount. Incidentally, the above description is exemplified by the change from the rocking drive mode to the forward rotating drive mode, however, at the time of changing from the forward rotating drive mode to the rocking drive mode, the inverse control to that described above is executed, that it, the drive mode is changed in a state in which the valve time area is made to coincide, and the opening degree of the throttle valve 36 is thereafter increased while gradually reducing the lift amount in the rocking drive mode.

Figure 15:
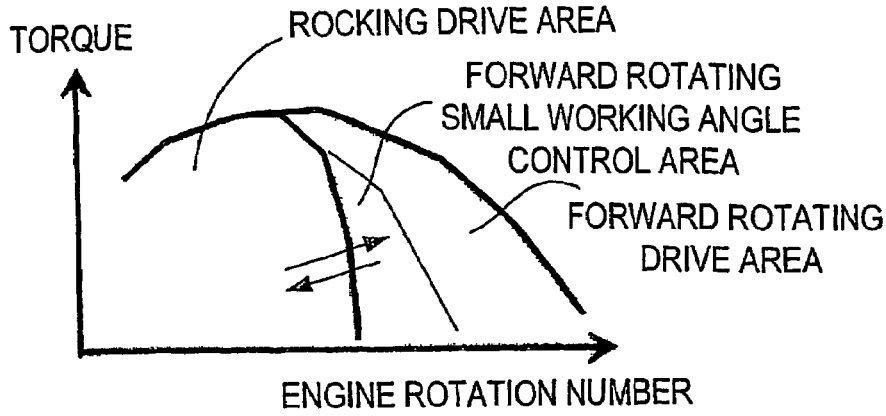
FIG. 15 is a graph showing an example that a forward rotating small working angle control region in which the working angle is controlled to be small is set at a position adjacent to a region to which the rocking drive mode is applied, within a region to which the forward rotating drive mode is applied.
Figure 16:
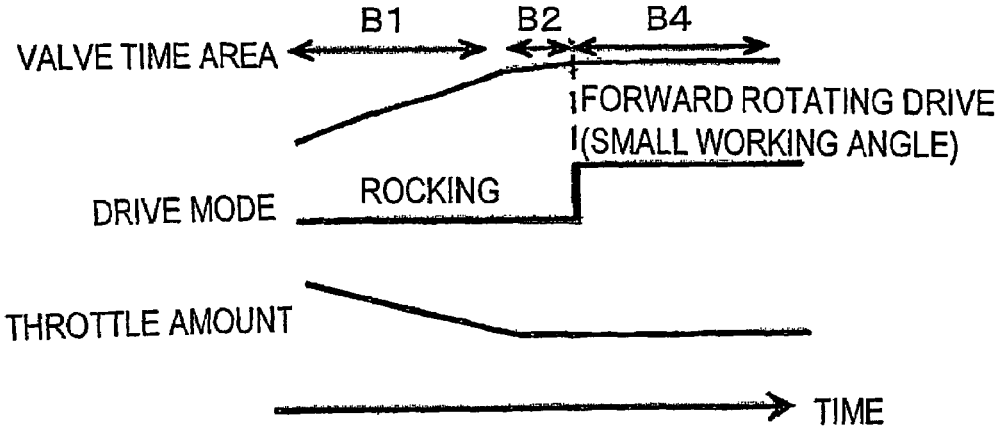
FIG. 16 is a diagram showing the other example of the corresponding relationship of the time area of the intake valve, the drive mode of the cam and the throttle amount at the time of changing between the rocking drive mode and the forward rotating drive mode when the forward rotating small working angle control region is provided as shown in FIG. 15.

In the structure described above, the lift amount is controlled intentionally small in the rocking drive mode, however, in the forward rotating drive mode, it is possible to intend to reduce the pumping loss by restricting the valve time area small in the same manner by controlling the working angle small as shown in FIGS. 9 and 10, while increasing the opening degree of the throttle valve 36 in place thereof. For example, as shown in FIG. 15, a map in which a forward rotation small working angle control region for controlling the working angle small is set is employed at a position adjacent to a region in which the rocking drive mode is applied within the region in which the forward rotating drive mode is applied, in place of the map in FIG. 5. In this case, when changing to the forward rotating drive mode from the rocking drive mode as shown in FIG. 16, the lift amount is first changed such that the valve time area is gradually increased in the rocking drive mode, and the opening degree (the throttle amount) of the throttle valve 36 is gradually reduced (a section B1), the valve time area is made to coincide with that in the forward rotating drive mode, and the change to the forward rotating drive mode (in this case, the forward rotation small working angle control region) is thereafter executed (a section B4).

Figure 17:
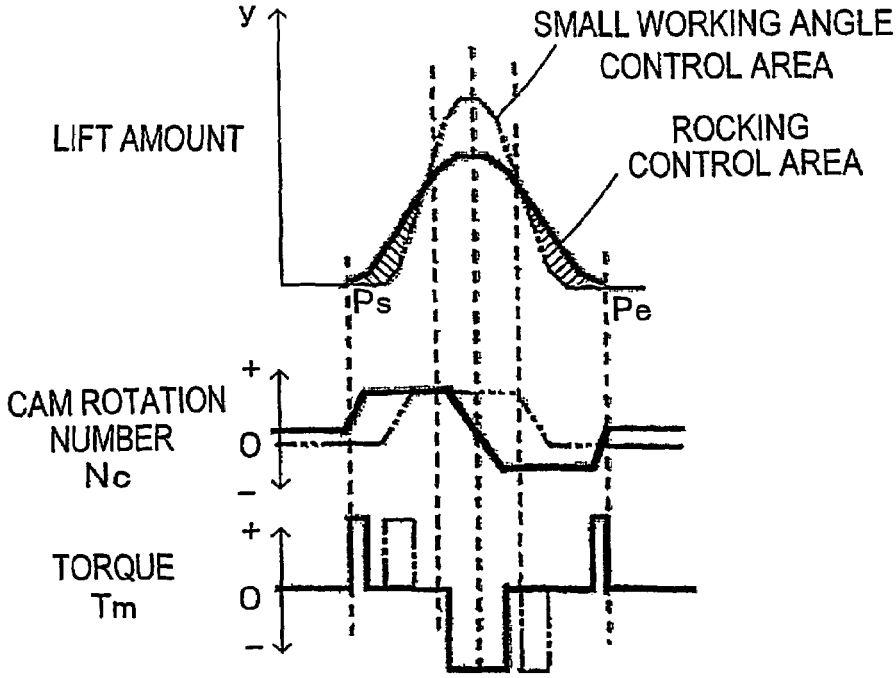
FIG. 17 is a diagram showing a corresponding relationship of the crank angle, the lift amount of the intake valve, the rotation number of the cam and the output torque of the motor, in a section B2 in FIG. 16.

Incidentally, in the case of interposing the forward rotation small working angle control region, both the valve time areas are made to coincide with each other by expanding the working angle in the rocking drive mode larger than that in the forward rotation small working angle control region, while controlling the maximum lift amount in the rocking drive mode smaller than that of the forward rotation small working angle control region, in the section B2 as shown in FIG. 17. In this case, it is desirable to coincide the maximum lift position Pp in the rocking drive mode and the maximum lift position Pp in the forward rotation small working angle region with each other.

When the forward rotation small working angle region is provided, it is not necessary to always execute the increase of the lift amount and the reduction of the throttle amount in the rocking drive mode as far as it is possible to coincide the valve time area at the time of changing the mode as shown in FIG. 17. However, a lower limit value in correspondence to the rotation number of the internal combustion engine exists in view of the response in the range of the working angle which is realizable in the forward rotating drive mode. The existence of the lower limit value of rotation number of the engine causes the valve time area in the forward rotation small working angle region to have a lower limit thereof, and there is a case that it is impossible to coincide the time area without changing the lift amount, in some setting of the lift amount in the rocking drive mode. In such case, the control in the section B1 in FIG. 16 is essential.

(Other Example of Motion of Cam in Rocking Drive Mode)

Figure 18A:
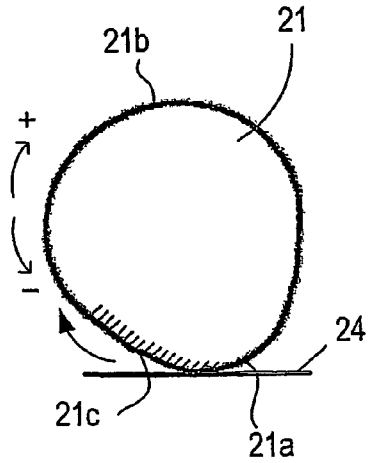
FIG. 18 is a view showing a state of continuously driving the cam during the intake valve stops in the rocking drive mode.
Figure 18B:
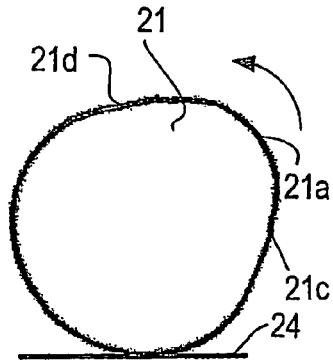
Figure 18C:
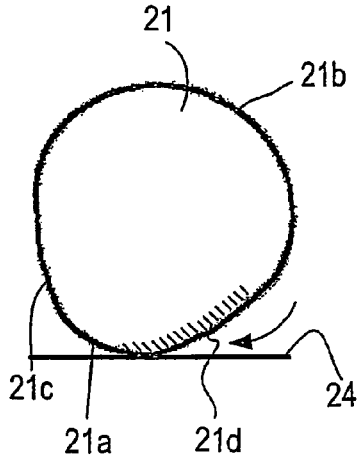
Figure 19:
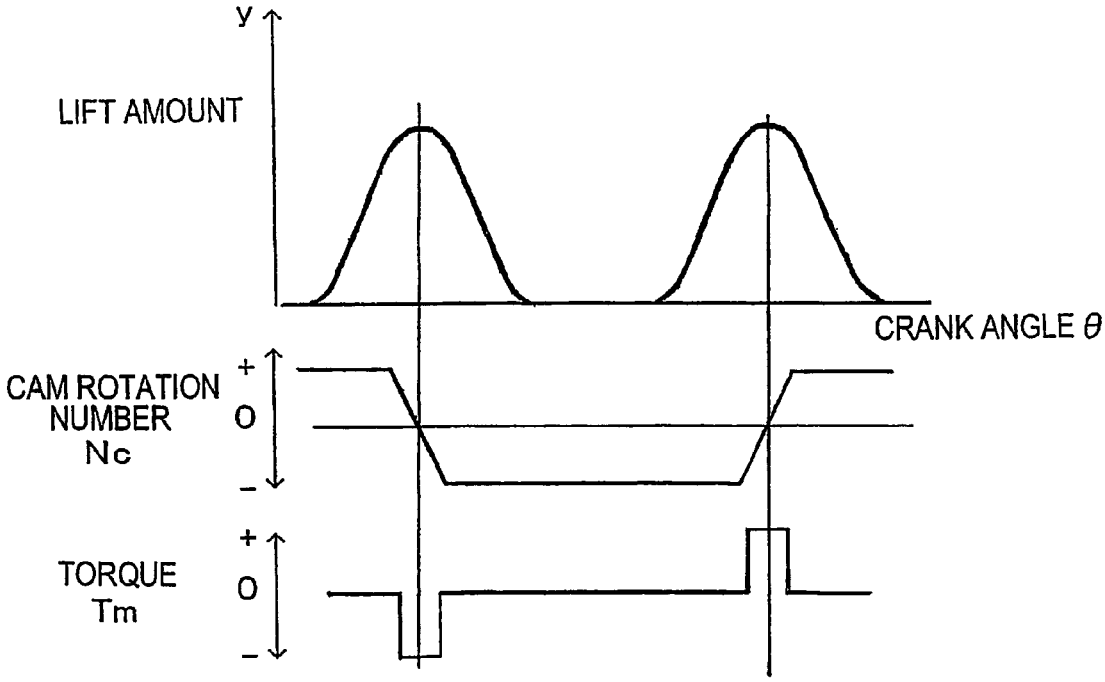
FIG. 19 is a diagram showing a corresponding relationship of the crank angle, the lift amount, the rotation number of the cam and the output torque of the motor, when a driving method in FIG. 18 is applied.

FIGS. 18 and 19 show the other driving method of the cam 21 in the rocking drive mode. In each of the embodiments described above, only the region 21*c* which is in one side from the nose 21*a* of the cam 21 is used as shown by applying a hatching to FIG. 4B, by forward and backward rotating the cam 21 in a narrower region than one circuit in the rocking drive mode as shown in FIG. 4B. On the contrary, in the driving method shown in FIGS. 18A to 18C, the cam 21 is actuated such that both sides of the nose 21*a* of the cam 21 are alternately used. In other words, the intake valve 2 is lifted by rotating the cam 21 in a forward rotating direction (a direction +) as shown in FIG. 18A with using the region 21*c* in one side of the nose 21*a*, thereafter the intake valve 2 is closed by driving the cam 21 in an inverse rotating direction (a direction −), and thereafter the cam 21 is continuously driven in the inverse direction as shown in FIG. 18B without stopping the cam 21. Further, the intake valve 2 is lifted by using a region 21*d* in an opposite side to the nose 21*a* while inversely rotating the cam 21 at the next opening and closing time of the intake valve 2, and thereafter, the intake valve 2 is closed by returning the cam 21 in the forward rotating direction. Thereafter, the cam 21 is continuously driven in the forward rotating direction. It is possible to open and close the intake valve 2 by repeating the motions described above, thereby alternately using the regions 21*c* and 21*d* in both sides of the nose 21*a* of the cam 21.

FIG. 19 shows a corresponding relationship of the crank angle θ, the lift amount y of the intake valve 2, the rotation number Nc of the cam 21 and the torque Tm of the motor 12, in the case of driving the cam 21 as described above. As is apparent from the example, according to the driving method alternately using both sides 21*c* and 21*d* with respect to the nose 21*a* of the cam 21, the cam 21 always rotates except the maximum lift position Pp of the intake valve 2, and the motor 12 is stopped in a low frequency. Accordingly, it is possible to prevent an oil film in the cam mechanism 14 from being short due to the stop of the cam 21, and it is possible to improve a lubricating performance in each of the portions of the cam mechanism 14. Further, a friction resistance is reduced based on an improvement of the lubricating performance, and it is possible to drive the motor 12 by a smaller load. Further, since the stop frequency of the motor 12 is reduced, an effective torque to be output by the motor 12 can be made small, and it is possible to select the smaller motor. Further, there is an advantage that both sides 21*c* and 21*d* of the cam 21 can be uniformly utilized and the biased abrasion can be prevented.

In the embodiments described above, the description is given of the control of the intake valve 2, however, the present invention can be applied to the control of the exhaust valve 3. The present invention is not limited to the 4-cycle internal combustion engine in which the crank shaft serving as the engine output shaft rotates at two times from the start of the intake stroke to the end of the exhaust stroke, but may be applied to a 2-cycle internal combustion engine in which the strokes from intake to exhaust are finished during one rotation of the engine output shaft. In this case, the basic speed of the cam coincides with the rotating speed of the engine output shaft.

The invention claimed is:

1. A valve gear of an internal combustion engine driven by an electric motor, the valve gear comprising:

electric motor control means being capable of actuating the electric motor in a rocking drive mode in which a rotating direction of a cam is changed during a lift of a valve of a cylinder, the valve being driven to be opened and closed based on a linear motion, wherein, a rotational motion of the electric motor is converted into the linear motion, which drives the valve to be opened and closed, by the cam, the electric motor control means including a rocking control means for controlling a motion of the electric motor such that the cam starts rotating before the valve starts lifting in the rocking drive mode, and wherein the rocking control means controls the rotating speed of the cam in the rocking drive mode such that a target working angle of the valve is realized and a target of a time area obtained by integrating a lift amount of the valve is realized.

2. The valve gear according to claim 1, wherein the rocking control means controls a rotating speed of the cam in the rocking drive mode such that the rotating speed of the cam at the time of starting the lift of the valve becomes higher than a basic speed obtained by dividing a rotating speed of an engine output shaft of the internal combustion engine by a rotation number of the engine output shaft from a start of an intake stroke to an end of an exhaust stroke.

3. The valve gear according to claim 1, wherein the rocking control means alternately uses both sides with respect to a nose of the cam so as to lift the valve, by rotating the cam in the same direction until the next change during the lift, after changing the rotating direction of the cam during the lift of the valve.

4. A valve gear of an internal combustion engine driven by an electric motor, the valve gear comprising:

electric motor control means being capable of actuating the electric motor in a forward rotating drive mode in which a cam is continuously rotated in one direction, wherein a valve of a cylinder is driven so as to be opened and closed based on a linear motion, a rotational motion of an electric motor being converted into the linear motion for driving the valve of the cylinder by the cam, the electric motor control means including a forward rotating control means for changing a rotating speed of the cam before the valve starts lifting in the forward rotating drive mode so as to change a working angle of the valve, and wherein the forward rotating control means changes the rotating speed of the cam in the forward rotating drive mode such that a target working angle of the valve is realized and a target of a time area obtained by integrating lift amount of the valve is realized.

5. The valve gear according to claim 4, wherein the forward rotating control means changes the rotating speed of the cam to a predetermined speed which is different from a basic speed obtained by dividing a rotating speed of an engine output shaft of the internal combustion engine by a rotation number of the engine output shaft from a start of an intake stroke to an end of an exhaust stroke, before starting the lift of the valve, and rotates the cam at the predetermined speed during the lift of the valve.

6. A valve gear of an internal combustion engine converting a rotational motion of an electric motor into a linear motion by a cam, and driving a valve of a cylinder so as to be opened and closed based on the linear motion, comprising:

electric motor control means capable of actuating the electric motor in each of a forward rotating drive mode in which the cam is continuously rotated in one direction, and a rocking drive mode in which a rotating direction of the cam is changed during a lift of the valve, wherein the electric motor control means comprises changing control means for controlling a motion of the electric motor in at least any one of the rocking drive mode and the forward rotating drive mode such that a time area obtained by integrating a lift amount of the valve approximately coincides between before and after changing the mode, at the time of changing the rocking drive mode and the forward rotating drive mode.

7. The valve gear according to claim 6, wherein the changing control means control the motion of the electric motor in the rocking drive mode such that a maximum lift amount of the valve in the rocking drive mode is increased according to being closer to the changing time of the mode.

8. The valve gear according to claim 7, wherein the changing control means controls an opening degree of a throttle valve of the internal combustion engine such that the opening degree of the throttle valve is reduced according to an increase of the maximum lift amount.

* * * * *